US007883153B2

(12) United States Patent
Stiffler et al.

(10) Patent No.: US 7,883,153 B2
(45) Date of Patent: Feb. 8, 2011

(54) ROAD MILLING DRUM HAVING AN ADJUSTABLE WIDTH

(75) Inventors: Stephen P. Stiffler, New Enterprise, PA (US); Eric P. Helsel, New Enterprise, PA (US); Donald E. Keller, Bedford, PA (US); Don C. Rowlett, Bedford, PA (US)

(73) Assignee: Kennametal Inc., Latrobe, PA (US)

( * ) Notice: Subject to any disclaimer, the term of this patent is extended or adjusted under 35 U.S.C. 154(b) by 581 days.

(21) Appl. No.: 11/900,168

(22) Filed: Sep. 10, 2007

(65) Prior Publication Data

US 2009/0067927 A1 Mar. 12, 2009

(51) Int. Cl.
*E01C 23/12* (2006.01)

(52) U.S. Cl. ..... 299/80.1; 299/39.5

(58) Field of Classification Search ..... 299/39.4–39.9, 299/80.1

See application file for complete search history.

(56) References Cited

U.S. PATENT DOCUMENTS

| | | | | |
|---|---|---|---|---|
| 4,704,045 | A | 11/1987 | Taylor et al. | |
| 4,720,207 | A | 1/1988 | Salani | |
| 4,755,001 | A | 7/1988 | Gilbert | |
| 5,505,598 | A * | 4/1996 | Murray | 404/90 |
| 5,722,789 | A | 3/1998 | Murray et al. | |
| 6,213,560 | B1 | 4/2001 | Lindblom | |
| 6,877,818 | B1 | 4/2005 | Gaertner et al. | |

FOREIGN PATENT DOCUMENTS

WO WO 01/04422 A1 1/2001

OTHER PUBLICATIONS

Notification of Transmittal of the International Search Report and the Written Opinion of the International Searching Authority for PTC/US2008/075219 mailed Jan. 12, 2009 (4 pages).
Written Opinion of the International Searching Authority for PCT/US2008/075219 mailed Jan. 12, 2009 (4 pages).
International Search Report for PCT/US2008/075219 mailed Jan. 12, 2009 (3 pages).

* cited by examiner

*Primary Examiner*—John Kreck
(74) *Attorney, Agent, or Firm*—Matthew W. Smith

(57) ABSTRACT

A road milling drum assembly that is for use with a road milling machine. The road milling drum includes a core portion carrying a first road planing bit assembly wherein the core portion detachably connects to the road milling machine. The first road planing bit assembly has a first milling width. The assembly further including one of the following components selected from the group of: (1) a protective cover that detachably connects to the core portion and the road milling machine; or (2) a milling extension segment carrying a second road planing bit assembly wherein the milling extension segment detachably connects to the core portion and the road milling machine. The second road planing bit assembly has a second milling width wherein the road milling drum has a milling width equal to the sum of the first milling width and the second milling width.

8 Claims, 3 Drawing Sheets

ROAD MILLING DRUM HAVING AN ADJUSTABLE WIDTH

BACKGROUND OF THE INVENTION

The invention pertains to a road milling drum wherein the road milling drum, which carries a plurality of road milling bits, is a component of a road milling machine. More specifically, the invention pertains to an improved road milling drum wherein the road milling drum, which carries a plurality of road milling bits (or road planing bits) and is a component of the road milling machine, is capable of modification to adjust (or vary) its lateral cutting width.

Over time and use, a roadway becomes worn and uneven to necessitate renovation or resurfacing thereof. A typical way to resurface the roadway is by the removal of the top layer or region of roadway material (e.g., asphaltic material or concrete or the like) by the use of a road milling machine. In other words, a road milling machine mills roadway surfaces to remove a top layer or region of material prior to resurfacing.

A road milling machine comprises many components, but a major component thereof is a road milling drum. Typically, a road milling drum is a cylindrical drum that carries a plurality (e.g., sometimes hundreds) of road milling bits at the surface thereof. In this regard, U.S. Pat. No. 6,877,818 B1 to Gaertner et al. discloses a road milling drum. When in operation, the road milling machine drives the road milling bits carried by the road milling drum into the top region of the roadway to break up the top region into pieces. Many times, and especially in the case of asphaltic roadway material, a conveyor transports the pieces into a truck or the like for transport to a recycling facility.

The removal of roadway material generally must satisfy pre-determined government specifications. Oftentimes, these specifications require very specific milling widths for the removal of roadway material. Further, the milling widths for a particular job may vary at different locations throughout the job site. While the contractor could use a number of road milling machines wherein each road milling machine would address a specific cutting width, such a strategy would require an inordinately large investment in road milling machines. In addition, such a strategy would tie up a number of road milling machines on one milling job.

In order to address a situation wherein the milling widths for a particular job may vary at different locations throughout the job, contractors have used road milling drums with adjustable milling widths. In this regard, the following United States patent documents discloses road milling drums that possess the capability to adjust the milling width: U.S. Pat. No. 5,505,598 to Murray, U.S. Pat. No. 5,722,789 to Murray et al. and U.S. Pat. No. 6,213,560 to Lindblom. Even though the above-listed patents disclose adjustable width road milling drums that address a situation wherein the milling widths for a particular job site may vary at different locations throughout the job, these road milling drums have drawbacks.

In earlier adjustable-width road milling drums, one significant drawback has been that critical regions where the drum attaches to the machine are exposed to the dirt and debris inherent in a road milling operation. These critical regions contain exposed bolt heads, threaded holes, keyways, and the like that collect dirt and debris thereby rendering it more difficult to detach the drum from the machine. Such an increase in the difficulties connected with detaching the drum from the machine increases operating costs and decrease operating efficiencies for the roadway milling operation.

Earlier adjustable-width road milling drums require many drum segments in order to achieve the desired milling widths.

The need to keep many drum segments on hand at the job site increases the overall expense for the roadway milling operation.

It becomes apparent that there would be an advantage to provide a road milling drum that can accommodate different milling widths. It is also apparent that there would be an advantage to provide a road milling drum that can accommodate different milling widths, and wherein the critical regions where the drum attaches to the machine are protected from exposure to the dirt and debris inherent in a road milling operation. Finally, it becomes apparent that there would be an advantage to provide a road milling drum that can accommodate different milling widths without the need to use many drum segments.

SUMMARY OF THE INVENTION

In one form thereof, the invention is a road milling drum assembly for use with a road milling machine in a roadway milling operation generating debris. The road milling drum comprises a drum core portion that carries a first road planing bit assembly. The drum core portion detachably connects to the road milling machine. The first road planing bit assembly has a first milling width. A protective cover detachably connects to the drum core portion and the road milling machine.

In yet another form thereof, the invention is a road milling drum assembly for use with a road milling machine in a roadway milling operation generating debris. The road milling drum comprises a drum core portion that carries a first road planing bit assembly. The drum core portion detachably connects to the road milling machine. The first road planing bit assembly has a first milling width. A milling extension segment carries a second road planing bit assembly. The milling extension segment detachably connects to the drum core portion and the road milling machine. The second road planing bit assembly has a second milling width wherein the road milling drum has a milling width equal to the sum of the first milling width and the second milling width.

In still another form thereof, the invention is a road milling drum assembly for use with a road milling machine in a roadway milling operation generating debris. The road milling drum comprises a core portion that carries a first road planing bit assembly. The core portion detachably connects to the road milling machine. The first road planing bit assembly has a first milling width. The assembly includes one of the following components selected from the group comprising: (1) a protective cover that detachably connects to the core portion and the road milling machine; or (2) a milling extension segment that carries a second road planing bit assembly wherein the milling extension segment detachably connects to the core portion and the road milling machine. The second road planing bit assembly has a second milling width wherein the road milling drum has a milling with equal to the sum of the first milling width and the second milling width.

In another form thereof, the invention is a road milling drum assembly for use with a road milling machine in a roadway milling operation generating debris. The road milling drum comprises a cylindrical core portion that carries a first road planing bit assembly. The cylindrical core portion detachably connects to the road milling machine. The first road planing bit assembly has a first milling width. The assembly further includes one or more of the following components a protective cover detachably connecting to the cylindrical core portion and the road milling machine wherein the road milling drum has a milling width with equal to the first width; or a first milling extension segment carrying a second road planing bit assembly, the first milling extension segment detachably connecting to the cylindrical core portion and the road milling machine, and the second road planing bit assembly having a second milling width; or a second milling extension segment carrying a third road planing bit assembly, the second milling extension segment detachably connecting to the cylindrical core portion and the road milling machine, and the third road planing bit assembly having a third milling width.

BRIEF DESCRIPTION OF THE DRAWINGS

A brief description of the drawings that form a part of this patent application now follows.

DETAILED DESCRIPTION

Figure 1:
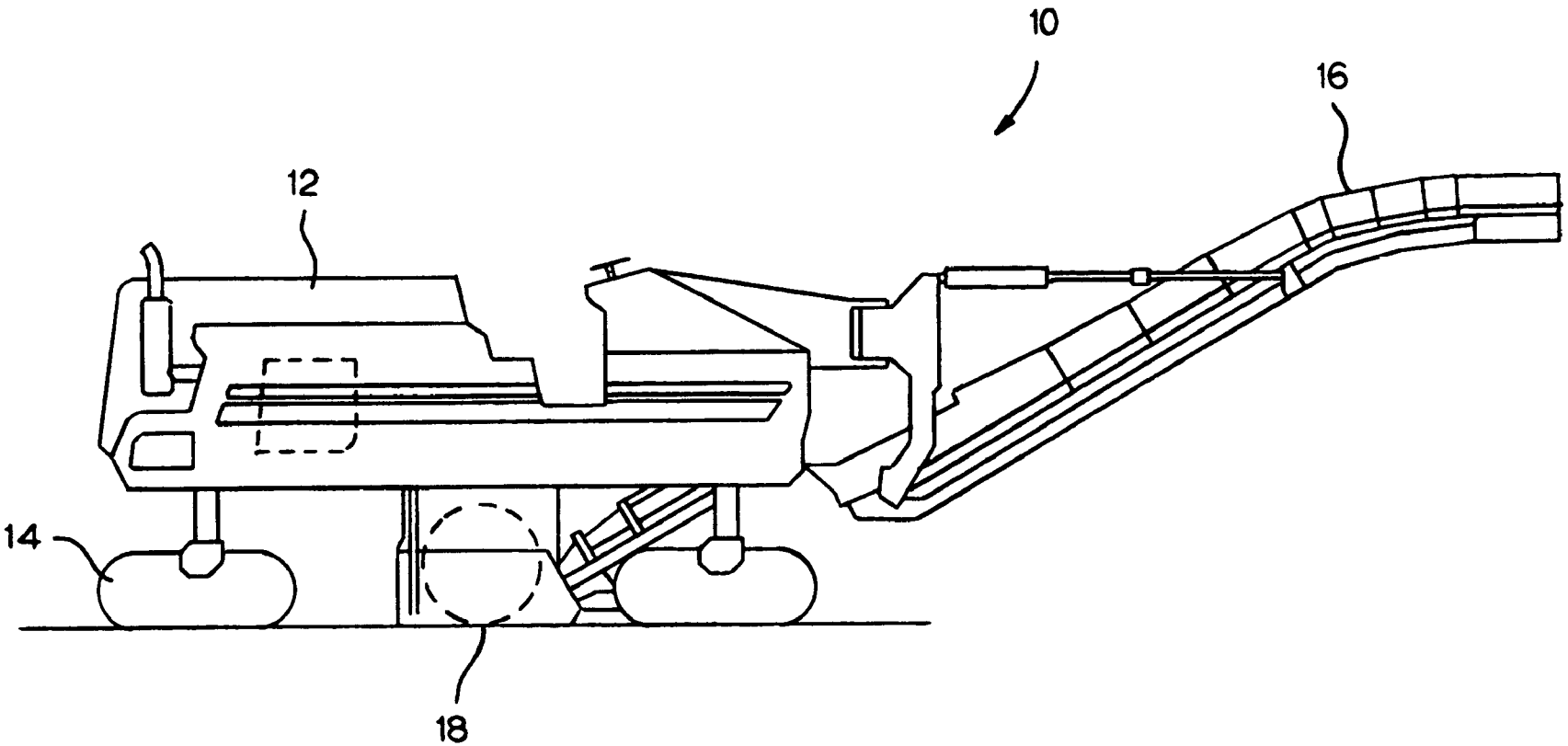
FIG. 1 is a side view of a road milling machine that uses the road milling drum of the present invention.

FIG. 1 shows a road milling machine generally designated as 10. Road milling machine 10 includes a machine body 12 that contains the engine and controls, as well as other components, for the overall machine. The machine body 12 rides on crawler-tracks 14 or in the alternative could ride on wheels. A conveyor 16 is operatively connected to the machine body 12 so that broken-up roadway material enters the conveyor 16 whereby it is typically transported to a dump truck or the like for removal from the job site. The machine body 12 houses the cylindrical road milling drum 18.

Figure 2:
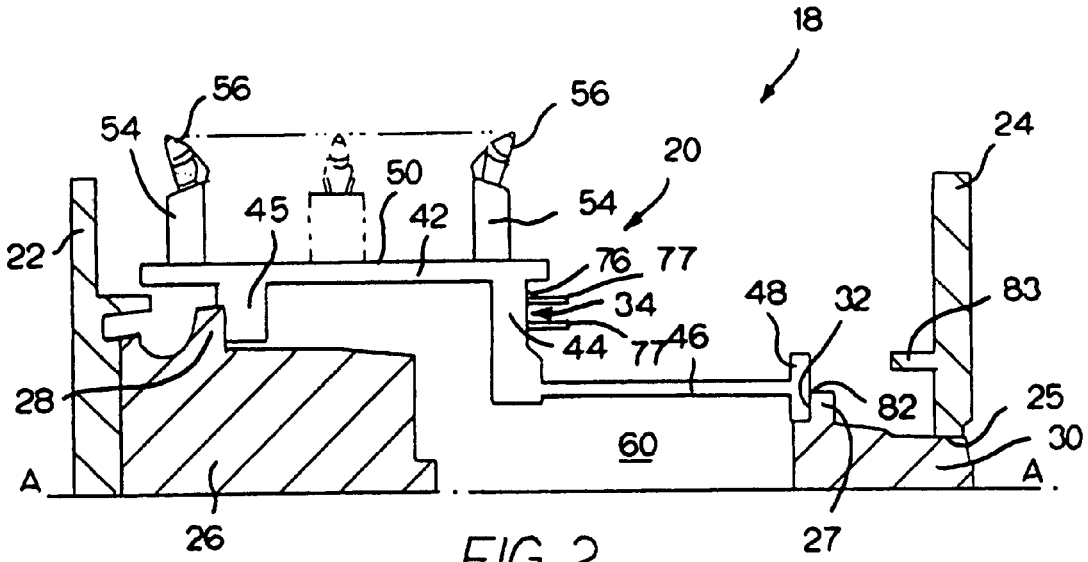
FIG. 2 is a side cross-sectional mechanical schematic view of the upper half of the core portion without the protective cover or the milling extension attached thereto.

FIG. 2 illustrates a specific embodiment of a cylindrical road milling drum core portion generally designated as 20 of the present invention. The core portion 20 is a part of the overall road planing drum 18. The core portion 20 is contained within the housing (22, 24) that is a part of the machine body 12.

A planetary gear assembly 26, which has a radial outward projection 28, affixes (via, e.g., bolts or the like) to the housing 22 and also affixes to the core portion 20 of the drum radially and laterally as will described in more detail hereinafter. The planetary gear assembly also provides rotational driving force from the engine (or the like) to the drum core portion 20.

A stub shaft 30, which has a channel 32, affixes (via, e.g., bolts or the like) to a flange 48 inside the core portion of the drum as described in more detail hereinafter. The stub shaft 30 also slides into a carrier bearing 25 in the housing 24. The stub shaft 30 rotates within the bearing 25. The stub shaft 30 supports the drum radially and permits the drum to rotate relative to the housing.

The cylindrical drum core portion 20 also has a torque transmission area generally designated as 34. It is preferable that the torque transmission area contain a plurality of dowels 77 that project in an axial fashion wherein these dowels engage the milling extension segments or the protective cover as described hereinafter. As described above. The engagement between the cylindrical core portion of the drum and the cylindrical milling extension segment(s) (or cylindrical protective cover) is axial in nature, which means that the projections project along in a direction parallel to the transverse axis of the drum. There should be an appreciation that in place of dowel pins, splines, keys or the like could function to provide a positive mechanical axial connection to transfer the torque from the cylindrical drum core portion 20 to the attached cylindrical component (e.g., milling extension segment).

The road milling machine 10 provides power (typically via hydraulics) to the planetary gear assembly 26. The planetary gear assembly 26 then provides torque to the drum core 20. As described above, the connection between the cylindrical drum core 20 and the attached component such as, for example, a cylindrical milling extension segment, is axial in nature as shown especially in FIG. 4A. This axial connection also means that the torque is applied to the cylindrical milling extension segments (see FIGS. 4 and 5) in an axial fashion to provide positive transfer of rotational force. Such an axial connection also eliminates axial seams in the drum that function to interrupt or block pedestal welding.

The cylindrical drum core portion 20 includes a radial outward peripheral member 42 that includes an interior radial inward projection 44 and an exterior radial inward projection 45. The drum core portion 20 also has an integral radial inward peripheral member 46 that terminates in a flange 48. A plurality of road planing bit assemblies attach to the surface 50 of the radial outward peripheral member 42 wherein each road planing bit assembly comprises a block (or holder) 54 and a road planing bit 56, which preferably is rotatable about its central longitudinal axis. The road planing bit 56 is rotatably retained within a bore in the block 54.

Cylindrical drum core portion 20 detachably connects (e.g., via a plurality of bolts) at the exterior radial inward projection 45 to the planetary gear assembly 26 in the region of the radial outward projection 28. It is at this location the planetary gear assembly drives the drum core portion. This connection is secure to provide efficient transfer of rotational force. Drum core portion 20 detachably connects (e.g., via a plurality of bolts) at the flange 48 to the stub shaft 30 in the region of the channel 32. The connection of the drum core portion 20 to the stub shaft 30 provides stability to the drum core portion 20. The connection between the drum core portion 20 and the planetary gear assembly 26 and the stub shaft 30 is a fluid-tight connection so that the interior volume of the drum functions as a coolant reservoir 60 for use by the planetary gear assembly 26.

Figure 3:
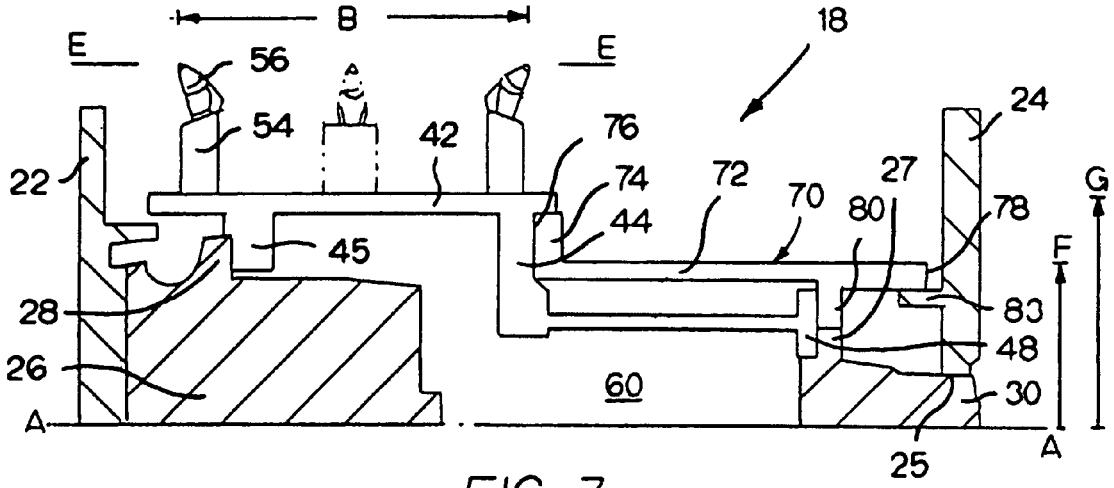
FIG. 3 is a side cross-sectional mechanical schematic view of the upper half of the core portion with the protective cover attached thereto wherein the milling width of the road milling drum is at a minimum milling width.

FIG. 3 shows the road milling drum 18 with a cylindrical protective cover generally designated as 70 connected to the road milling drum core 20. The road milling drum 18 is in an operable condition as shown in FIG. 3. Cylindrical protective cover 70 includes an elongate body 72 with an interior radial outward protection 74 at the interior end thereof and an exterior radial inward projection 80 adjacent to the exterior end 78 thereof. The protective cover 70 connects at the interior radial outward projection 74 to the drum core portion 20 at the channel 76 of interior radial inward projection 44. More specifically, the outward projection 74 of the protective cover 70 contains bores that align with and receive dowels pins 77 that project (in an axial direction) from the channel 76 of the inward projection 44. Further, the protective cover 70 connects (e.g., via a plurality of bolts) at the exterior radial inward projection 80 to the flange 48 of the drum core 20, as well as to the stub shaft 30 at projection 27. The exterior end 78 of the protective cover 70 is adjacent to a transverse flange 83 (projecting transversely inward) of housing 24.

FIG. 3 shows the road milling drum 18 in a condition in which during operation, it rotates about its transverse axis A-A and it has a milling width "B". In this specific embodiment, the milling width "B" is the minimum milling width of the road milling drum. There should be an appreciation that the distal ends of the road planing bits 56 lie in the same plane E-E, which is generally parallel to the central axis A-A of the drum. Such an orientation facilitates an even roadway surface (or substrate) from the milling operation. Further, the radius "F" of the generally cylindrical protective cover 70 is less than the radius "G" for the drum core 20. The existence of a non-cutting component (e.g., the protective cover) with a smaller radius than the cutting component (e.g., the drum core carrying the road planing bits) allows the drum to cut at greater depths when compared to an arrangement in which the non-cutting component has a radius generally the same as the radius of the drum core portion.

There should be an appreciation that the cylindrical protective cover 70 protects the planetary gear assembly 26, the torque transmission area 34 (including the dowels pins) and the stub shaft 30 from contamination by dirt and debris from the roadway milling operation. Further, there should be an appreciation that the points of connection between the drum core 20 and the planetary gear assembly 26, the torque transmission area 34 and the stub shaft 30 that are impacted by a harsh operating environment are protected from contamination by dirt and debris from the roadway milling operation.

As discussed earlier herein, the removal of roadway material generally must satisfy pre-determined government specifications wherein these specifications oftentimes require very specific milling widths for the removal of roadway material. Further, the milling widths for a particular job may vary at different locations throughout the job site. As described below, if there must be an increase in the milling width, the contractor/operator can easily remove the cylindrical protective cover and replace it with a cylindrical milling extension segment to achieve a greater milling width. In the case where the milling drum carries segments in addition to the drum core 20, if there must be a decrease in the milling width, the contractor/operator can easily remove the cylindrical milling extension segment and replace it with a cylindrical protective cover or another cylindrical milling extension segment of a different milling width to achieve a smaller milling width. There should be an appreciation that in addition to the cylindrical drum core, the drum can carry a cylindrical protective cover and a cylindrical milling extension. Preferably, the dimensioning of the components should be such so that the components (including the drum core) extend along essentially the entire width of the drum.

If the roadway milling operation requires a different milling width from width "B", which in this case means an increase in the milling width from the minimum milling width, to the contractor (or operator) must remove the road milling drum 18 from the bearing to detach the protective cover 70 from the core 20. In reference to FIG. 4, the contractor/operator then detachably connects one specific embodiment of the cylindrical milling extension segment generally designated as 90 to the cylindrical core 20. The cylindrical milling extension segment 90, which has an overall generally cylindrical geometry, has a milling extension segment body 92 that has an interior radial inward projection 94 adjacent to the interior end thereof and an exterior radial inward projection 96 adjacent to the exterior end thereof.

There should be an appreciation that the points of attachment for the cylindrical milling extension segment 90 to the cylindrical core 20 are the same for the attachment of the cylindrical protective cover 70 to the cylindrical core 20. For example, the milling extension segment 90 connects to the channel 76 of the interior radial inward projection 44. The milling extension segment 90 connects (e.g., via a plurality of bolts or the like) at the exterior radial inward projection 96 to the flange 48 of the drum core 20 adjacent the channel 32. The projection 96 of the milling extension segment 90 also attaches to the projection 27 of the stub shaft 30 to secure the segment 90 to the stub shaft 30. There should be an appreciation that the milling extension segment 90 is securely attached at its opposite ends to provide it with stability.

Figure 4:
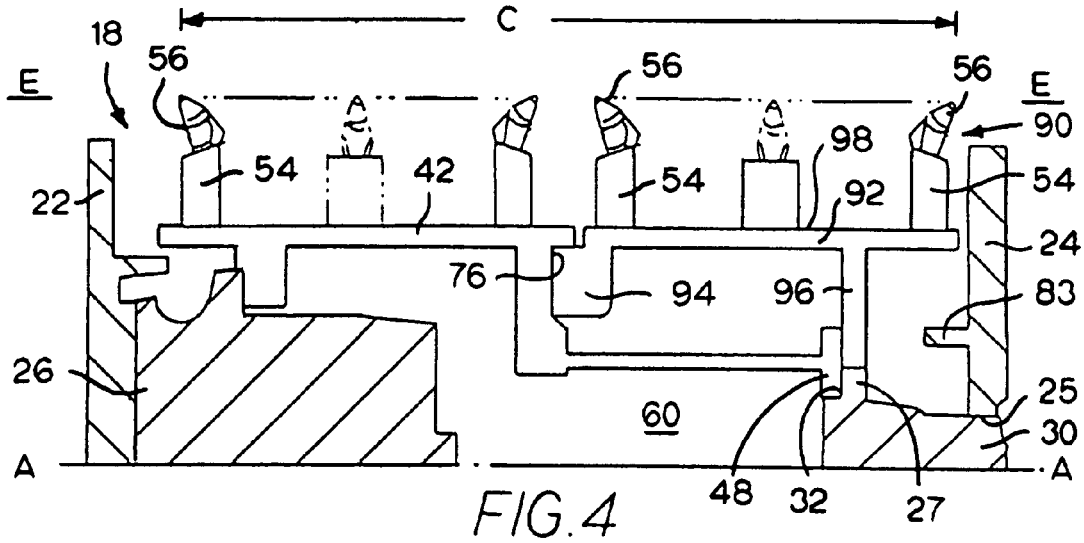
FIG. 4 is a side cross-sectional mechanical schematic view of the upper half of the core portion with one embodiment of the milling extension attached thereto wherein the milling width of the road milling drum is at a maximum milling width.
Figure 4A:
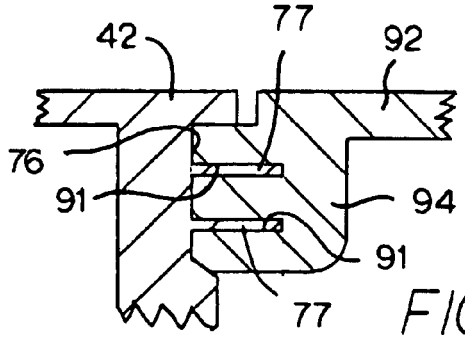
FIG. 4A is a cross-sectional view showing the axial connection between the core portion of the drum and the milling extension using dowel pins.

Referring to FIG. 4A, there is shown the connection between the cylindrical milling extension segment 90 and cylindrical drum core portion 20 wherein the connection is at the channel 76 of the interior radial inward projection 44. The inward projection 94 of segment 90 contains bores 91 that receive the dowels pins 77 that project from the channel 76 of projection 44. Such a connection is axial in nature and provides a secure and positive driving connection to efficiently transfer the rotational force from the drum core portion 20 to the milling extension segment.

FIG. 4 shows the road milling drum 18 in a condition in which during operation where it rotates about its transverse axis A-A it has a milling width "C". In this specific embodiment, milling width "C" is the maximum milling width. The distal ends of the road planing bits 56 lie in the same plane E-E, which is generally parallel to the central axis A-A of the drum. As described above, such an orientation facilitates an even roadway surface (or substrate) from the milling operation.

There should be an appreciation that the road milling drum protects the planetary gear assembly 26, the torque transmission area 34 and the stub shaft 30 from contamination by dirt and debris from the roadway milling operation. Further, there should be an appreciation that the points of connection between the drum core 20 and the planetary gear assembly 26, the torque transmission area 34 and the stub shaft 30 that are impacted by a harsh operating environment are protected from contamination by dirt and debris from the roadway milling operation. There should also be an appreciation that the protective cover 70 (FIG. 3) and the milling extension segment 90 (FIG. 4) can be attached or detached to the core drum portion 20 without draining the coolant from the coolant reservoir 60.

As mentioned above, government specifications oftentimes require very specific milling widths for the removal of roadway material so that a required milling width may be different from either minimum milling width "B" or maximum milling width "C". The present road milling drum 18 can accommodate a situation in which the roadway milling operation requires a different milling width from either a minimum milling width "B" or a maximum milling width "C" to such as, for example, an intermediate milling width "D" (see FIG. 5).

In the case where the milling width must increase from the minimum milling width B" to an intermediate milling width "D", the contractor (or operator) must remove the road milling drum 18 from the bearing to detach the cylindrical protective cover 70 from the cylindrical core 20. The contractor/operator then detachably connects the second embodiment of a cylindrical milling extension segment 110 to the cylindrical core 20. The core 20 and the second embodiment of the milling extension segment 110 together have a milling width "D".

In the case where the milling width must decrease from the maximum milling width "C" to an intermediate milling width "D", the contractor (or operator) must remove the road milling drum 18 from the bearing to detach the cylindrical milling extension segment 90 from the cylindrical core 20. The contractor/operator then detachably connects the second embodiment of a cylindrical milling extension segment 110 to the cylindrical core 20. The core 20 and the second embodiment of the milling extension segment 110 together have a milling width "D".

The cylindrical milling extension segment 110 has a radial outer milling extension segment body portion 112 that has an interior end 114 and an exterior end 116. The body portion 112 has an interior radial inward projection 118 (which contains bores (not illustrated) like bores 91 in projection 94) adjacent to the interior end 114. The milling extension 110 further has a radial inner body portion 120 that has an interior end 122 and an exterior end 124. A radial arm 128 depends in a radial inward direction from radial outer body portion 112 to join with the radial inner body portion 120. An exterior radial inward projection 130 projects in a radial inward direction from the radial inner body portion 120.

As one can appreciate, the points of attachment for the second embodiment of the cylindrical milling extensions segment 110 to the cylindrical core 20 are essentially the same as for the protective cover 70 or the milling extension segment 90. More specifically, the milling extension segment 110 connects via the bores in the interior radial inward projection 118 that receive the dowel pins projecting from the channel 76 of the interior radial inward projection 44. Further, the milling extension segment 110 connects (e.g., via a plurality of bolts) at the exterior radial inward projection 130 to the flange 48 of the drum core 20 adjacent the channel 32, as well as to the stub shaft 30 at flange 27. The exterior end 124 is adjacent to the transverse flange 83 (projecting inwardly) of the housing 24.

Figure 5:
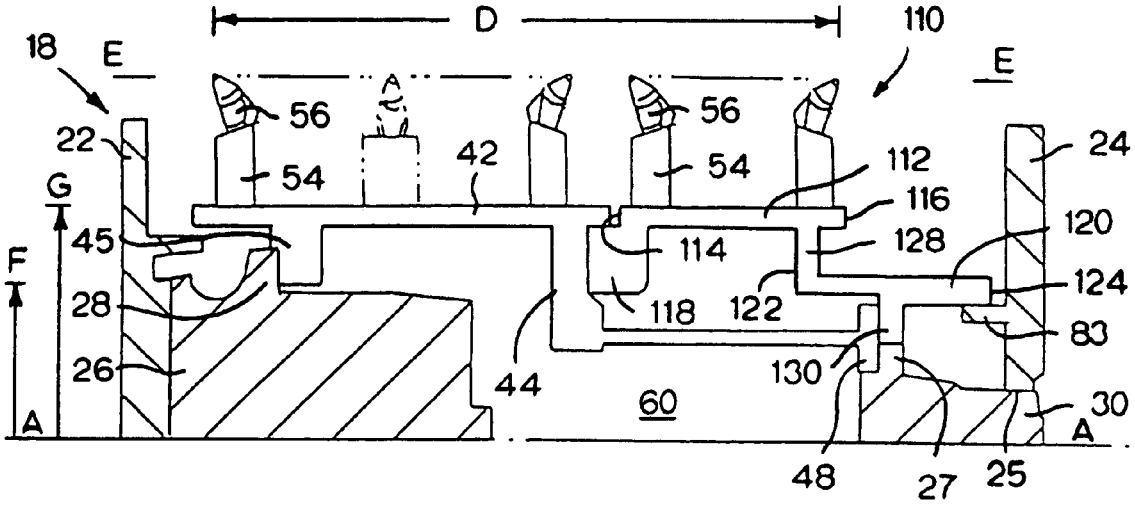
FIG. 5 is a side cross-sectional mechanical schematic view of the upper half of the core portion with another embodiment of the milling extension attached thereto wherein the milling width of the road milling drum is at an intermediate milling width.

FIG. 5 shows the road milling drum 18 in a condition in which during operation where it rotates about its transverse axis A-A it has a milling width "D". The distal ends of the road planing bits 56 lie in the same plane E-E, which is generally parallel to the central axis A-A of the drum. As described above, such an orientation facilitates an even roadway surface (or substrate) from the milling operation. Further, the radius "F" of the radial inner milling extension segment body portion 120 is less than the radius "G" for the drum core 20. The existence of a non-cutting component (e.g., the body portion 120) with a smaller radius than the cutting component allows the drum to cut at greater depths when compared to an arrangement in which the non-cutting component has a radius generally the same as the radius of the drum core portion.

There should be an appreciation that the planetary gear assembly 26, the torque transmission area 34 and the stub shaft 30 are protected from contamination by dirt and debris from the roadway milling operation. Further, there should be an appreciation that the points of connection between the drum core 20 and the planetary gear assembly 26, the torque transmission area 34 and the stub shaft 30 are protected from contamination by dirt and debris from the roadway milling operation. There should also be an appreciation that the protective cover 70, the milling extension segment 90, and the second milling extension segment 110 can attach or detach to the core drum portion 20 without draining the coolant from the coolant reservoir 60. There should also be an appreciation that the cylindrical protective cover or the cylindrical milling extensions segments can slide off the dowels in an axial direction once disconnected from the cylindrical drum core and the stub shaft. This allows for an easier connection and disconnection of the milling extension segments (or protective cover) to the drum core.

There should be an appreciation that the present invention provides an improved road milling drum that can accommodate different milling widths through the use of multiple segments. These segment are relatively easy to attach or detach from the core of the road milling drum.

There should also be an appreciation that the present invention provides an improved road milling drum that can accommodate different milling widths wherein the critical regions where the drum attaches to the machine are protected from exposed to the dirt and debris inherent in a road milling operation. The core segment itself and a protective cover provide this protection when only the core segment is used to mill the roadway. The core segment and the milling extension segment provide this protection when the core segment and the milling extension segment are used to mill the roadway.

Finally, it becomes apparent that there would be an advantage to provide a road milling drum that can accommodate different milling widths without the need to use many drum segments. In one situation, the road milling drum employs a core segment and one milling extension segment. However, there should be an appreciation that in other circumstances, the cylindrical drum core could carry more than one component. In essence, to accommodate certain circumstances, the operator could mix and match the components to achieve the desired milling width and milling result.

The patents and other documents identified herein are hereby incorporated by reference herein. Other embodiments of the invention will be apparent to those skilled in the art from a consideration of the specification or a practice of the invention disclosed herein. It is intended that the specification and examples are illustrative only and are not intended to be limiting on the scope of the invention. The true scope and spirit of the invention is indicated by the following claims.

What is claimed:

1. A road milling drum assembly for use with a road milling machine in a roadway milling operation generating debris, the road milling drum assembly comprising:

a cylindrical core portion carrying a first road planing bit assembly, and the cylindrical core portion detachably connecting to the road milling machine;

the first road planing bit assembly having a first milling width wherein the first milling width is a minimum milling width of the road milling drum assembly; and a selected one of the following components:

a protective cover detachably connecting to the cylindrical core portion and the road milling machine, whereby the road milling drum assembly comprising the cylindrical core portion and the protective cover, and the milling width of the road milling drum assembly being equal to the first milling width; or a first milling extension segment carrying a second road planing bit assembly, the first milling extension segment detachably connecting to the cylindrical core portion and the road milling machine, and the second road planing bit assembly having a second milling width, whereby the road milling drum assembly comprising the cylindrical core portion and the first milling extension segment, and the milling width of the road milling drum assembly being equal to the sum of the first milling width and the second milling width wherein the sum of the first milling width and the second milling is a maximum milling width of the road milling drum assembly; or a second milling extension segment carrying a third road planing bit assembly, the second milling extension segment detachably connecting to the cylindrical core portion and the road milling machine, and the third road planing bit assembly having a third milling width, whereby the road milling drum comprising the cylindrical core portion and the second milling extension segment, and the milling width of the road milling drum assembly being equal to the sum of the first milling width and the third milling width wherein the sum of the first milling width and the third milling width is an intermediate milling width of the road milling drum assembly wherein the intermediate milling width is greater than the minimum milling width and less than the maximum milling width; and wherein the cylindrical core portion containing a bore;

when the selected component being the protective cover, the protective cover having a dowel, and the bore receiving the dowel;

when the selected component being the first milling extension segment, the first milling extension segment having a dowel, and the bore receiving the dowel;

when the selected component being the second milling extension segment, the second milling extension segment having a dowel, and the bore receiving the dowel.

2. The road milling drum assembly of claim 1 wherein the protective cover being cylindrical, the first milling extension segment being cylindrical and the second milling extension segment being cylindrical.

3. A road milling drum assembly for use with a road milling machine in a roadway milling operation generating debris, the road milling drum comprising:

a drum core portion carrying a first road planing bit assembly, and the drum core portion detachably connecting to the road milling machine;

the first road planing bit assembly having a first milling width;

a milling extension segment carrying a second road planing bit assembly, the milling extension segment detachably connecting to the drum core portion and the road milling machine:

the second road planing bit assembly having a second milling width wherein the road milling drum has a milling width equal to the sum of the first milling width and the second milling width; and wherein the road milling drum having a maximum milling width, and wherein the maximum milling width being greater than a sum of the first milling width and the second milling width, and the first road planing bit assembly having a first radius, the second road planing bit assembly having a non-milling portion having a second radius, and the first radius being greater than the second radius, and wherein the drum core portion containing a bore, and the milling extension segment having a dowel, and the bore receiving the dowel.

4. The road milling drum assembly of claim 3 wherein the drum core portion having an axial torque transmission projection, and the protective cover protecting the torque transmission projection from the debris.

5. The road milling drum assembly of claim 3 wherein the drum core portion having an axial torque transmission projection, and the milling extension segment protecting the torque transmission projection from the debris.

6. A road milling drum assembly for use with a road milling machine in a roadway milling operation generating debris, the road milling drum comprising:

a core portion carrying a first road planing bit assembly, and the core portion detachably connecting to the road milling machine;

the first road planing bit assembly having a first milling width; and a selected one of the following components:

a protective cover detachably connecting to the core portion and the road milling machine wherein the road milling drum has a milling width equal to the first width; or a milling extension segment carrying a second road planing bit assembly, the milling extension segment detachably connecting to the core portion and the road milling machine, and the second road planing bit assembly having a second milling width wherein the road milling drum has a milling width equal to the sum of the first milling width and the second milling width; and wherein the core portion containing a bore;

when the selected component being the protective cover, the protective cover having a dowel, and the bore receiving the dowel;

when the selected component being the milling extension segment, the milling extension segment having a dowel, and the bore receiving the dowel.

7. The road milling drum assembly of claim 6 wherein the road milling drum having a maximum milling width, and when the selected component is the protective cover, the maximum milling width being greater than the first milling width.

8. The road milling drum assembly of claim 6 wherein the drum core portion having a first radius and the protective cover having a second radius, and when the selected component is the protective cover, the second radius being less than the first radius.

* * * * *